US006805599B1

(12) United States Patent
Huang

(10) Patent No.: US 6,805,599 B1
(45) Date of Patent: Oct. 19, 2004

(54) SELF-OPERATABLE INFLATION DEVICE

(75) Inventor: Kun Sheng Huang, Taipei Hsien (TW)

(73) Assignee: Ever-Quick Co., Ltd., Taipei Hsien (TW)

( * ) Notice: Subject to any disclaimer, the term of this patent is extended or adjusted under 35 U.S.C. 154(b) by 0 days.

(21) Appl. No.: 10/714,650

(22) Filed: Nov. 18, 2003

(51) Int. Cl.[7] ..... B63C 9/08
(52) U.S. Cl. ..... 441/88; 441/122
(58) Field of Search ..... 441/88, 92–94, 441/96, 122

(56) References Cited

U.S. PATENT DOCUMENTS 3,070,818 A * 1/1963 Fairchild ..... 441/93
3,173,162 A * 3/1965 Elder, Jr. ..... 441/94
4,629,436 A * 12/1986 Stewart et al. ..... 441/93
5,374,212 A * 12/1994 Lall ..... 441/96
6,004,178 A * 12/1999 Liu et al. ..... 441/96

FOREIGN PATENT DOCUMENTS

EP 223321 A2 * 5/1987 ..... B63C/9/16

* cited by examiner

*Primary Examiner*—Jesus D. Sotelo
(74) *Attorney, Agent, or Firm*—Rosenberg, Klein & Lee

(57) ABSTRACT

A safety device includes a base and a cap pivotably connected to the base at one end thereof. The cap has a watch on a top thereof and a protrusion extending from an underside thereof. A pressurized air container has its sealed end inserted in an opening of the protrusion and a distal end of the container extends from the cap. A passage is defined in the protrusion and a cylindrical member is movably received. The cylindrical member includes a probe which is located in the chamber of the protrusion and beside the sealed end of the container. An inflatable piece is received in the base and has an inlet member which is engaged with the chamber defined in the protrusion. A link is pivotably connected between the cylindrical member and the cylindrical member such that when pivoting the container, the link moves the cylindrical member to let the probe break through the sealed end of the container such that the inflatable piece is inflated.

7 Claims, 5 Drawing Sheets

SELF-OPERATABLE INFLATION DEVICE

FIELD OF THE INVENTION

The present invention relates to a safety device attached to a limb of a swimmer and includes a pressurized container and an inflatable piece which is inflated by pivoting the container.

BACKGROUND OF THE INVENTION

A conventional safety device attached to a limb of swimmers generally includes two chemical agents which are separated from each other when the safety device is not operated, and the two chemical agents are mixed with each other by breaking the packs of the agents so as to generate pressurized air to inflate a bladder. The chemical agents could fail their expected function due to humidity. Another safety device includes a flexible bottle such that the user squeezes the bottle to force the air into an inflatable piece. The user has to squeeze the nozzle of the bottle very hard to proceed the inflation process and it is inconvenient for some users. The direction that the pressurized air flows is the same as the inflation of the inflatable piece, if the nozzle of the bottle is accidentally jammed, it is difficult to re-open the bottle again. Some safety devices includes levers or pulling handles exposed which are easily to be pulled or tangled by objects around the users. Yet another type of the safety device includes a foldable bottle and a chemical agent has to be sent into the foldable bottle to inflate it. The chemical agent is sent by way of using a spring to move the bottle toward the chemical agent and this is not reliable during operation.

The present invention intends to provide a safety device with simple structure and the inflation is reliable and efficient.

SUMMARY OF THE INVENTION

The present invention relates to a safety device that comprises a base having a first end thereof pivotably connected to a first end of a cap, and a second end of the bas is disengagably connected to a second end of the cap. A watch is connected to a top of the cap and a protrusion extends from an underside of the cap. A pressurized air container is inserted in the protrusion from a side of the protrusion and an inflatable piece is connected to the protrusion and received in the base when the cap is mounted to the base. An end of the container extends from the cap. An activation assembly for breaking through the sealed end of the container is connected to a first end of the cap and a fastening belt is connected to an underside of the base.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
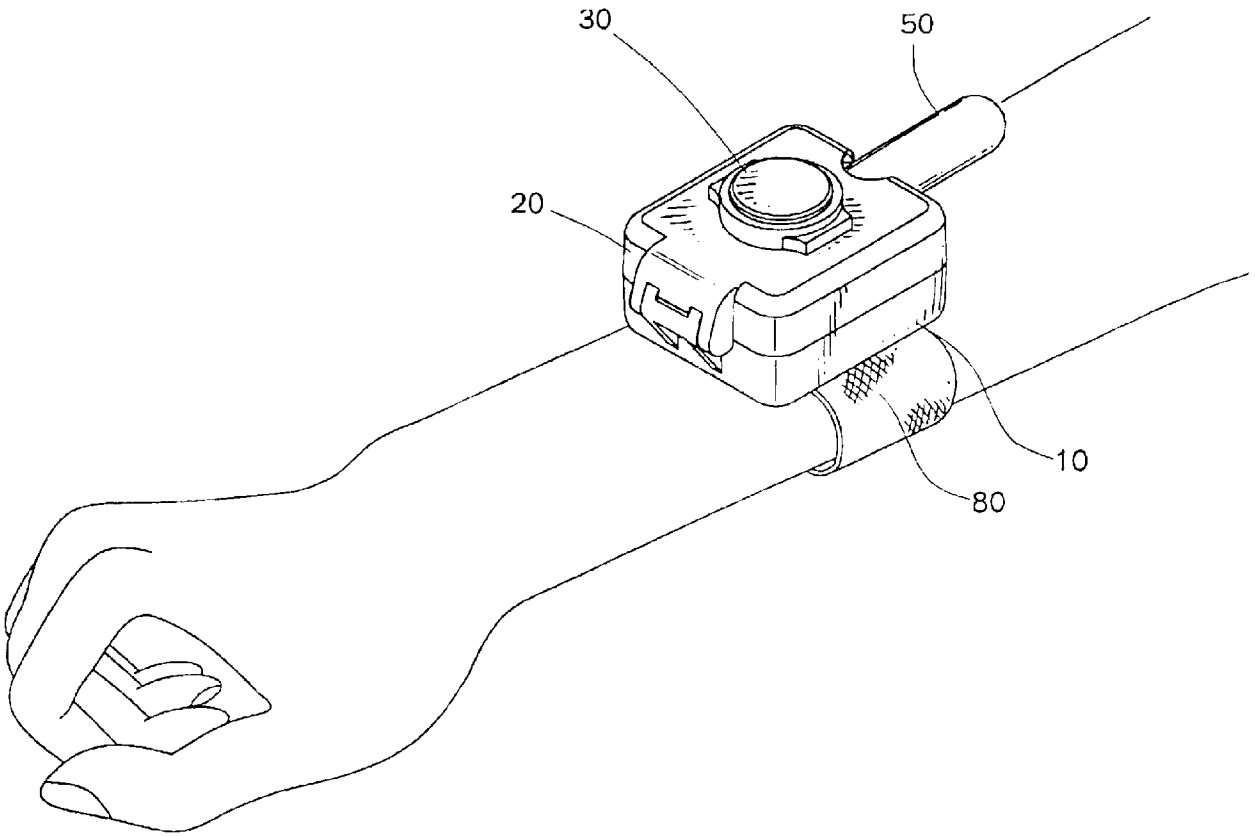
FIG. 1 shows the safety device is attached to an arm of a user.
Figure 2:
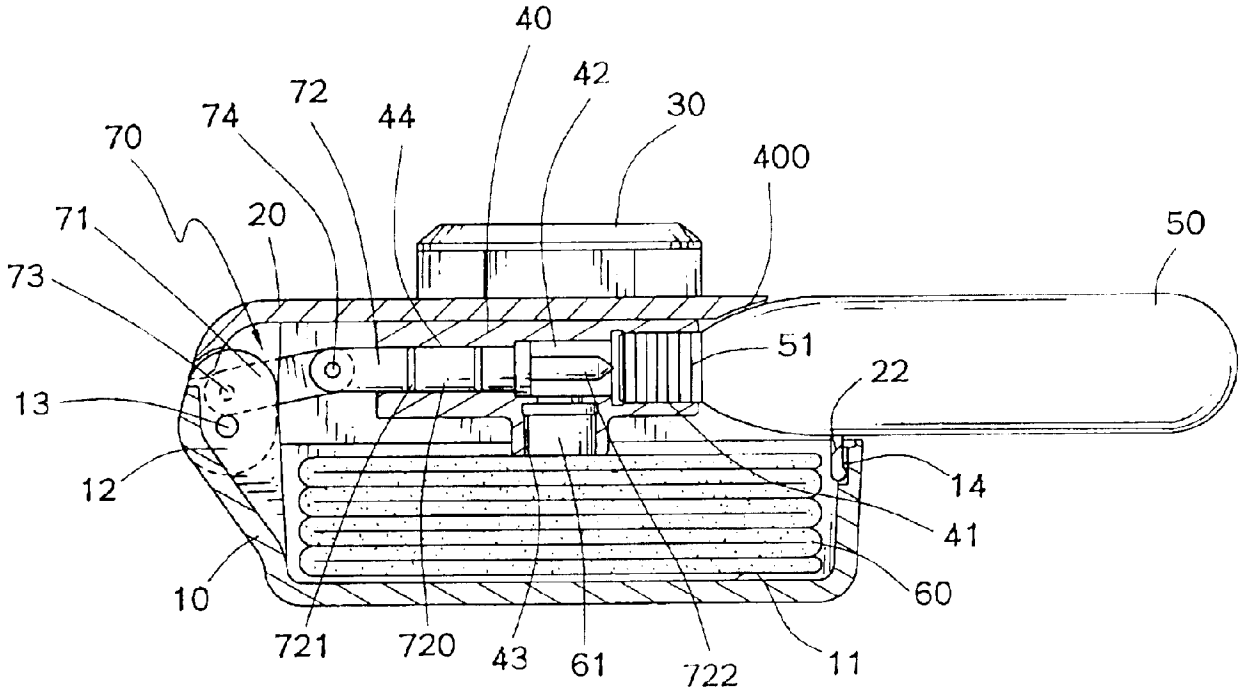
FIG. 2 is a side view to show the safety device when the cap is mounted to the base.
Figure 3:
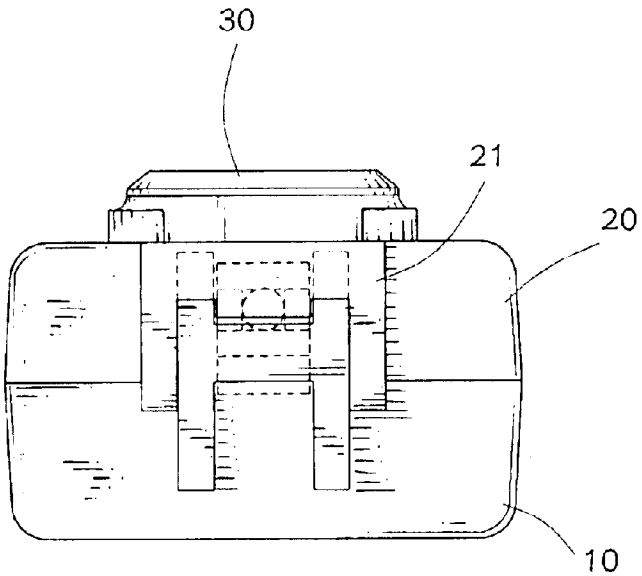
FIG. 3 is an end view showing that the cap is pivotably connected to the base.

Referring to FIGS. 1 and 2, the safety device for swimmers of the present invention comprises a base 10 having a first connection member 12 located at a first end of the base 10 and an engaging recess 14 is defined in an inside of the second end of the base 10. A cap 20 has a second connection member 21 located at a first end of the cap 20 so as to be pivotably connected to the first connection member 12 by extending a pin 13 through both of the first connection member 12 and the second connection member 21. An engaging piece 22 extends from the second end of the cap 20 such that when the cap 20 is mounted to the base 10, the engaging piece 22 is disengagably engaged with the engaging recess 14. A watch 30 is connected to a top of the cap 20.

A protrusion 40 extends from an underside of the cap 20 and includes an opening 400 through which a sealed end of a pressurized air container 50 is inserted such that a distal end of the container 50 extends from a side of the cap 20. The sealed end of the container 50 includes connection portion 51 which is engaged with a connection port 41 located in the opening 400.

An activation assembly 70 is connected to a first end of the cap 20 and the protrusion 40 includes a passage 44 through which a cylindrical member 72 of the activation assembly 70 is movably received. The cylindrical member 72 has a probe 722 with a sharp end which is located in a chamber 42 defined in the protrusion 40 and beside the seal end of the container 50. A plurality of seal rings 721 are mounted to a section 720 of the cylindrical member 72 and snugly engaged with an inner periphery of the passage 44.

The activation assembly 70 further includes a link 71 which has one end pivotably connected to an end of the cylindrical member 72 by a pin 74 and the other end of the link 71 is pivotably connected to the first connection member 12 by a pin 73 which is located above the pin 13.

An inflatable piece 60 is folded and received in a recess 11 in the base 10 when the cap 20 is mounted to the base 10. An inlet member 61 of the inflatable piece 60 is engaged with a fitting 43 which is engaged with the chamber 42 and communicates with the sealed end of the container 50. A fastening belt 80 is connected to an underside of the base 10 so as to be attached to a limb such as an arm of a swimmer.

Figure 4:
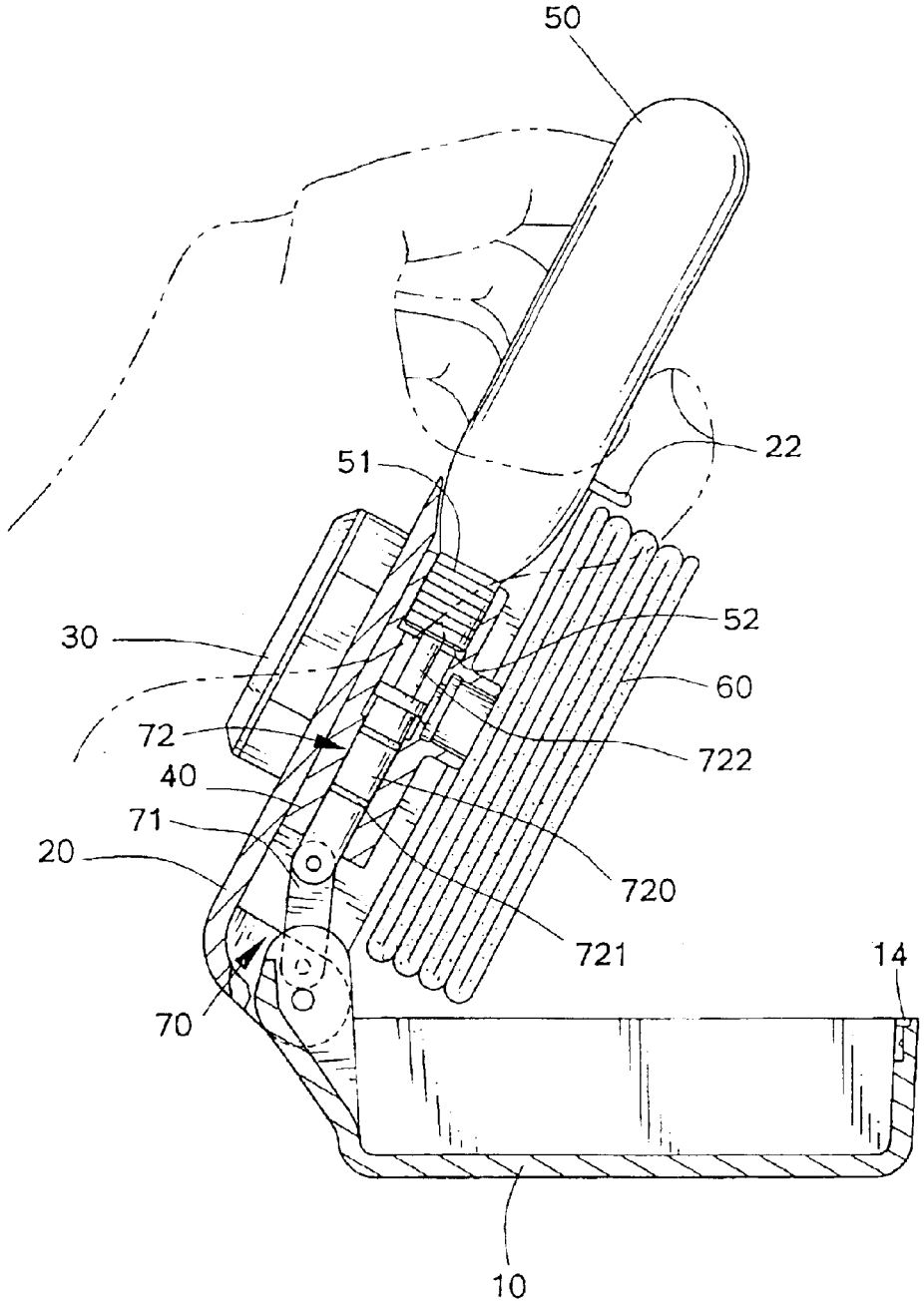
FIG. 4 shows the user pivoted the container upward and the probe breaks through the sealed end of the container.
Figure 5:
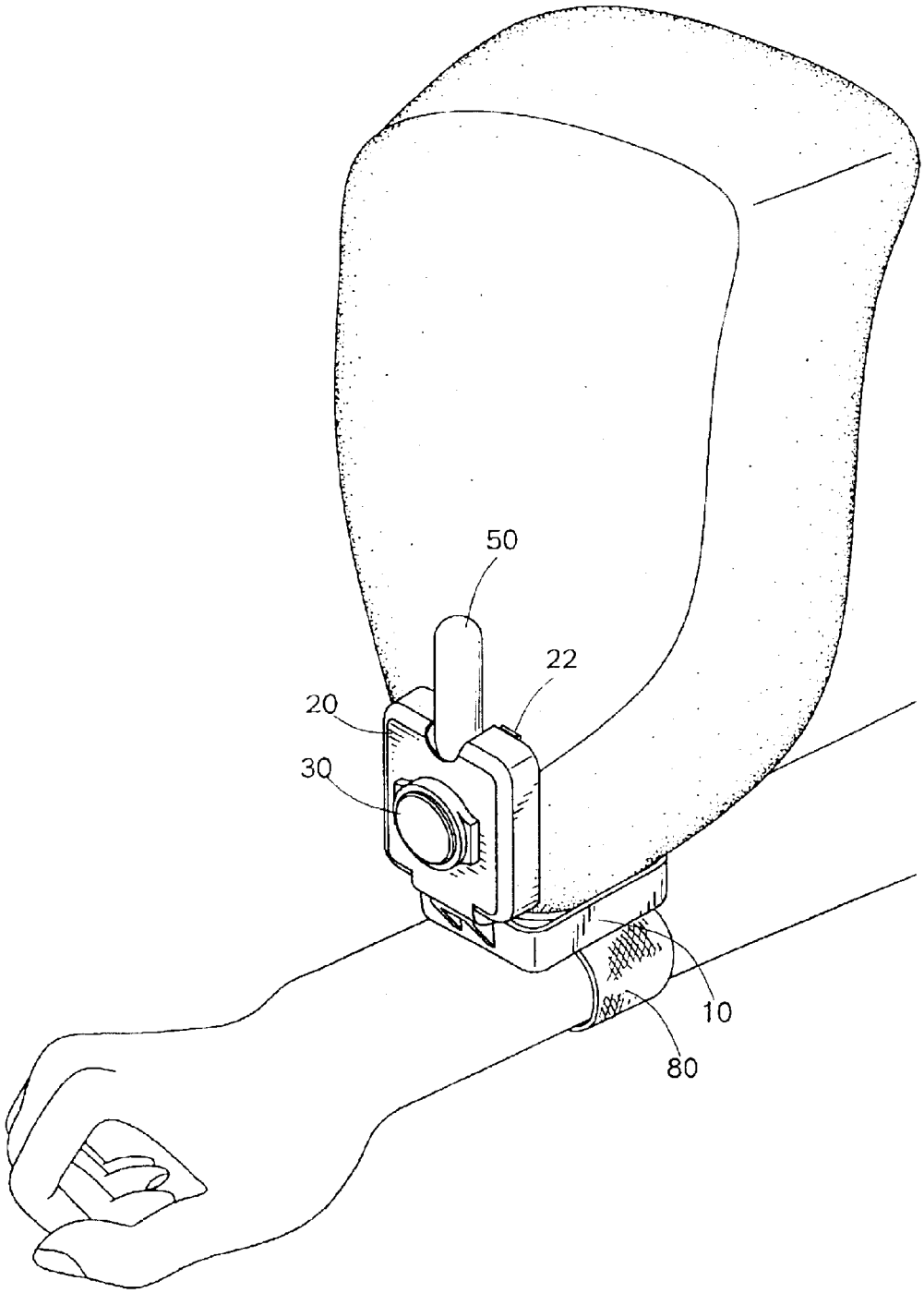
FIG. 5 shows the inflatable piece is inflated by pivoting the container upwardly.

As shown in FIGS. 4 and 5, when the user pivoted the container 50 upward to open the cap 20 from the base 10, the link 71 pushes the cylindrical member 72 to move toward the sealed end of the container 50 till the probe 722 penetrates through the sealed end to release the pressurized air which then enters the inflatable piece 60 via the inlet member 61 to inflate the inflatable piece 60 as shown in FIG. 5. It is to be noted that a longitudinal axis of the container 50 is located perpendicularly to a plane where the fastening belt 80 is located. In other words, the container 50 is parallel to the arm so that the container 50 will not be tangled or pivoted accidentally.

While we have shown and described the embodiment in accordance with the present invention, it should be clear to those skilled in the art that further embodiments may be made without departing from the scope of the present invention.

What is claimed is:

1. A safety device comprising:

a base (10) having a first end thereof pivotably connected to a first end of a cap (20), a second end of the base (10)

disengagably connected to a second end of the cap (20), a watch (30) connected to a top of the cap (20);

a protrusion (40) extending from an underside of the cap (20) and a pressurized air container (50) and an inflatable piece (60) respectively connected to the protrusion (40), the inflatable piece (60) being received in the base (10) when the cap (20) is mounted to the base (10), an end of the container (50) extending from the cap (20), and an activation assembly (70) connected to a first end of the cap (20) and a fastening belt (80) connected to an underside of the base (10).

2. The device as claimed in claim 1, wherein a first connection member (12) is located at the first end of the base (10) and a second connection member (21) is located at the first end of the cap (20), a pin (13) pivotably connecting the first connection member (12) and the second connection member (21), an engaging recess (14) defined in an inside of the second end of the base (10) and an engaging piece (22) extending from the second end of the cap (20), the engaging piece (22) disengagably engaged with the engaging recess (14).

3. The device as claimed in claim 1, wherein protrusion (40) includes an opening (400) through which the container (50) inserted and a sealed end of the container (50) is engaged with a connection port (41) located in the opening (400).

4. The device as claimed in claim 1, wherein the protrusion (40) includes a passage (44) through which a cylindrical member (72) of the activation assembly (70) is movably received and includes a probe (722) which is located in a chamber (42) defined in the protrusion (40) and beside the seal end of the container (50), an inlet member (61) of the inflatable piece (60) engaged with the chamber (42).

5. The device as claimed in claim 4, the activation assembly (70) includes a link (71) which is pivotably connected between an end of the cylindrical member (72) and the cap (20).

6. The device as claimed in claim 4 further comprising a plurality of seal rings (721) mounted to the cylindrical member (72) and snugly engaged with an inner periphery of the passage (44).

7. The device as claimed in claim 1, wherein a longitudinal axis of the container (50) is located perpendicularly to a plane where the fastening belt (80) is located.

* * * * *